United States Patent [19]

Erickson

[11] 4,078,755

[45] Mar. 14, 1978

[54] CLIP TYPE HANGER FOR APERTURE BOARDS

[76] Inventor: John Grover Erickson, 5143 Kings Cir., Racine, Wis. 53406

[21] Appl. No.: 792,572

[22] Filed: May 2, 1977

[51] Int. Cl.[2] ..... A47G 23/02

[52] U.S. Cl. ..... 248/220.3; 248/311.1 A

[58] Field of Search ..... 248/220.2, 220.3, 220.4, 248/221.1, 221.2, 224.4, 302, 311.1, 313

[56] References Cited

U.S. PATENT DOCUMENTS

| | | | |
|---|---|---|---|
| 1,203,942 | 11/1916 | Walker | 248/311.1 A |
| 2,316,103 | 4/1943 | Reed | 248/311.1 A |
| 2,636,704 | 4/1953 | Norberg | 248/302 X |
| 3,908,948 | 9/1975 | Hawthorne | 248/220.4 |
| 3,921,948 | 11/1975 | Long | 248/220.4 |
| 4,029,281 | 6/1977 | Marshall | 248/220.3 |

*Primary Examiner*—William H. Schultz
*Attorney, Agent, or Firm*—Arthur J. Hansmann

[57] ABSTRACT

A clip type hanger for aperture boards for supporting and displaying liquid container cans, such as a collector's array of beer cans or the like. A clip is made of a wire and is in a T-shape in the inverted position for the front view, and one end of the clip extends through a hole in the aperture boards and the opposite portion of the clip snaps on to the upper edge of the can or like item to be supported by and suspended from the clip. The clip is of one piece of bent wire of resilient characteristic and is shaped to have two free ends and a clipped central portion all on one plane whereby the central portion is on one side of the container edge and the free ends are on the other side of the container edge, and the clip is sprung onto the edge for securely holding the container.

8 Claims, 6 Drawing Figures

CLIP TYPE HANGER FOR APERTURE BOARDS

This invention relates to a clip type of hanger for aperture board, and, more particularly, it relates to a spring wire type of clip which is used in engaging the rim of a can for displaying the can on a aperture board or the like.

BACKGROUND OF THE INVENTION

Wire types of aperture boards clips are made in various configurations for the purpose of presenting a hook or for engaging a container, all for the purposes of supporting items on a aperture board. Of course the aperture board has holes through which one end of the clip can project while the other end of the clip is engaging the item suspended on the aperture board. These prior art clips are commonly made and shaped for specific purposes and according to the dictates of the particular item to be suspended or the container to be engaged and suspended by the clip. Examples of prior art wire type hangers are found in U.S. Pat. Nos. 906,127 and 3,027,036 and 3,045,961. As mentioned, those prior art clips are made for specific purposes, such that the clips of the last two aforesaid patents have substantially completely circular portions for engaging a container top, and the clip of the first mentioned patent is continuous in its lower portion which engages the planar piece to be supported, and that is much like the continuous loop or curvature of two legs of an ordinary paper clip. Thus, the clip of that patent can engage only the very edge of the planar piece to be supported, and the remainder of the clip will inherently be directed away from the front and back faces of the planar piece being supported so that the support is precarious and the clip is essentially open downwardly to invite and permit the supported piece to fall from the clip if the piece is jostled or of any significant weight.

Accordingly, it is an object and advantage of this invention to provide a clip for use with a aperture board and wherein the clip is a general improvement upon clips heretofore known and used with aperture board or the like. Specifically, the clip of this particular invention is one which can be readily and easily made and which can be readily and easily snapped onto and removed from the item supported and which securely holds the item supported. With regard to the advantage of security, the clip of this invention is arranged to have the free ends of the bent length of wire which forms the clip directed toward the item being supported so that the ends actually terminate at the supported item and can literally grip the item and can also be disposed under a rim which may be on the item, such as the rim of a drink container or the like.

Still another object of this invention is to provide a clip for use with aperture board and wherein the portion of the clip which engages the item to be supported is arranged for engaging a curved rim of the supported item, thereby permitting the secure support and the ready-and-easy attachment and detachment of the clip relative to the item.

Another object of this invention is to provide a aperture board type of clip for supporting drink containers, such as beer cans or the like on the display board, and to do so with a clip which presents the container in a secure upright orientation without having the container lean to either side or even lean back against the aperture board. That is, the clip of this invention retains the container in an upright orientation for purposes of presentable and attractive display of the item.

Other objects and advantages will become apparent upon reading the following description in light of the accompanying drawings.

DETAILED DESCRIPTION OF THE PREFERRED EMBODIMENTS

Figure 1:
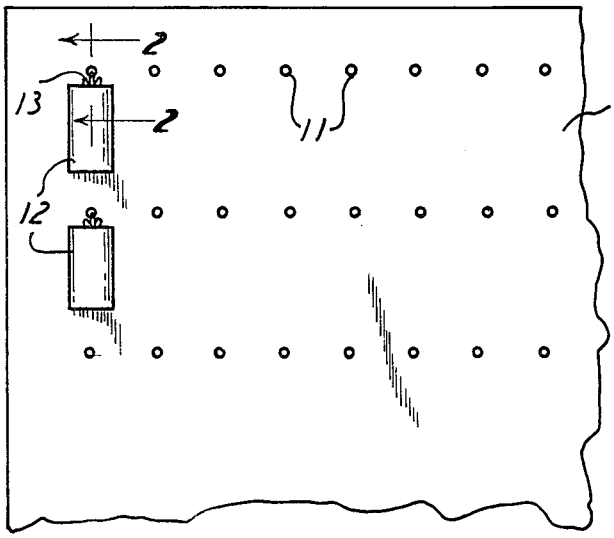
FIG. 1 is a front elevational view of a aperture board with containers or the like shown supported thereon by the clip of this invention.

The drawings show a aperture board 10 having the usual hole 11 extending therethrough, and items 12 are displayed on the board 10 by means of a clip 13 of this invention. The items 12 may be drink containers, such as a collector's display of beer cans or the like, and the clip 13 is that which is made according to this invention. Therefore, the clips 13 are placed individually on each can 12, and the clips have portions which extend into the aperture board opening 11 for supporting the items 12 on the face of the board 10.

Figure 2:
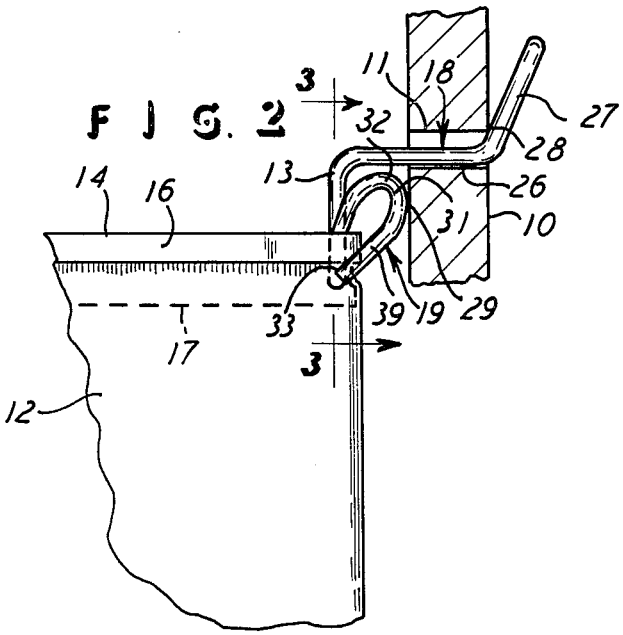
FIG. 2 is an enlarged side elevational view of the fragment of the board and container shown in FIG. 1 and showing the clip of this invention thereon, and with the view being taken along the line 2—2 of FIG. 1.

FIG. 2 shows the enlarged view of the clip 13 and a fragment of the board 10 and the container 12. The container has an upper edge or rim 14 which is circular and which is actually of a rolled-over nature to have the band 16 protrude therearound in the usual manner. The container top is indicated by the dotted line 17, and thus the rim or edge 14 extends above the container top 17, again in the usual manner.

Figure 3:
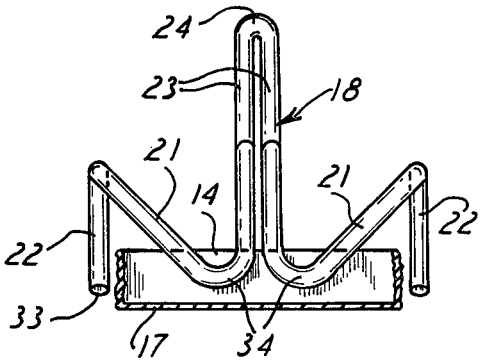
FIG. 3 is a front view of the clip shown in FIG. 2, and with the view being taken along the line 3—3 of FIG. 2 and showing a fragment of the container.
Figure 4:
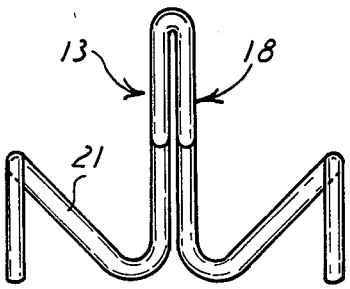
FIG. 4 is a rear view of the clip shown in FIGS. 2 and 3.

The clip 13 includes the central portion generally designated 18 and the two end portions generally designated 19. FIGS. 3 and 4 show the clip 13 to be substantially of a T-shape in the front or rear view thereof and of course with the clip shown in its normal upright position but with the T-shape being inverted. Thus the clip portion 18 presents the stem of the T-shape, and the clip has two side leg portions 21 which present the laterally extending top bar of the T-shape as described herein.

Therefore, it will be seen and understood that the clip 13 is made from one length of a basic wire material which has the characteristic of being resilient such that the wire will take the bend shown in the drawing but it will also have a degree of resilience or flexibility so that it can bend slightly from the positions shown to thereby firmly grip the item 12, in a manner described hereinafter. The length of bent wire therefore extends from one extending end portion 22 to the opposite extending end portion 22, and the central portion 18 has the two lengths or sections 23 which are parallel to each other and which are joined by the curved portion 24 at the very center of the total length of the wire forming the clip 13. Also, the clip central portion 18 is offset from the remainder of the clip, as seen in FIG. 2, and it has the substantially horizontally extending portion 26 and the upwardly angled portion 27, as shown in FIG. 2. Thus the portion 26 extends through the aperture boards opening 11, and the portion 22 is arranged so that it can abut the aperture boards back surface at the location designated 28. The clip also abuts the front face of the board, at the location designated 29, and that is achieved by the clip portion designated 31, as shown in FIG. 2. The clip 13 therefore has the laterally extending leg portions 22 which terminate in reversely curved end portions designated 32 and finally terminate in the end legs 22 which have free ends 33. In this configuration, the clip has the two curved portions 34 on the central portion 18, and, as shown in FIG. 2, the clip ends 33 and the central portion section 34 are disposed on the same upright plane, and thus the clip securely engages the curved rim 14 of the container 12 by having the clip central portion section 34 disposed inside the rim 14 and by having the clip leg ends 33 disposed outside the container rim 14. As such, the clip 13 securely holds the container 12 in a secure and upright position. Further, the clip can be easily attached to and removed from the container 12, and the resilient aspects of the clip, such as the tendency for the reversely curved leg portions 32 to bear inwardly against the container rim 14 are utilized for achieving the purposes mentioned herein.

Figure 6:
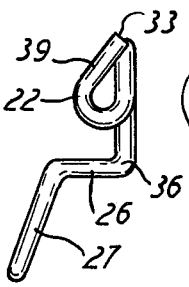
FIGS. 5 and 6 are front and side views, respectively, of a modified form of the clip of this invention.
Figure 5:
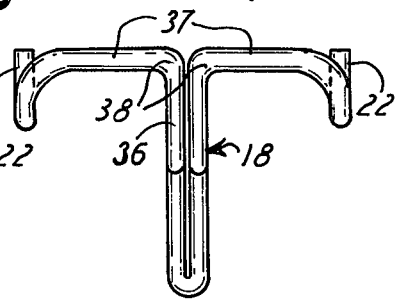

FIGS. 5 and 6 show a modification of the clip 13, and here it will be seen that there is a clip 36, and this clip also has the central portion 18 and the extending legs 22. However, the leg portions 21 of clip 13 are different in the FIGS. 5 and 6 embodiment in that the clip in FIGS. 5 and 6 has the leg portions designated 37, and those portions extend directly laterally from the central portion 18 and of course interconnect with the reversely curved leg portions 22.

In both embodiments, there is a clip type of hanger of a T-shape being made of a length of resilient bent and basic wire which is relatively stiff but yet resilient such that a slight deflection in the wire can be immediately and automatically recovered by the wire itself. Both clips present the central portion and the side leg portions 22, and the central portions 18 have the offset, such as shown at 26 and 27. Further, clip 13 has the central portion section 34 and the other clip has the central portion section 38, with both the sections 34 and 38 disposed on the plane which intersects the free ends 33 of the clip legs 22. Therefore, the clip portions 38 or 34 are disposed on the inside of the container rim 14 while the clip free ends 33 are disposed on the outside of the container rim 14, all for securely holding the container 12. Still further, it will be seen that the clip legs 22 have their portions designated 39 extending parallel with the central portion section 27, all for suitably supporting the item 12, as mentioned. The upright plane referred to is that designated by the section line 3—3 in FIG. 2, and it will also be noticed that the clip central portion 18 and the legs 22 are on the same side of that upright plane.

Accordingly, the clip is particularly useful for supporting drink containers which have a circular upper rim, in their plan views, such as the rim 14 shown herein. The clip of this invention is arranged to have four points of contact with that curved upper rim, namely, the two points of contact at the curvatures 34 and 38, on the inside of the curved rim 14, and the two points of contact of the clip free ends 33, on the outside of the curved rim. Also, since the free ends 33 are spaced from the curvature 34 and are inherently free ends relative thereto, the aforementioned four points of contact can be achieved well down on the rim 14 for uprightly and securely supporting the container on the aperture board.

What is claimed is:

1. A clip type of hanger for aperture boards for supporting items having an extending edge thereon, comprising a aperture board having holes therein, a clip consisting of a length of resilient wire bent into substantially a T-shape in an inverted front view and with the central portion thereof extending beyond the two side leg portions thereof and with said central portion having one section offset rearwardly relative to the remainder of said clip for extending into one of said holes of said aperture board, said side leg portions consisting of two reversely curved portions extending from said central portion and terminating in a free end of said wire, and said central portion having another section disposed on the upright plane intersecting said free ends and with said central portion another section and said free ends being arranged and disposed for engaging the opposite sides of the extending edge of the item supported by said hanger.

2. The clip type of hanger for aperture board for supporting items having an extending edge thereon as claimed in claim 1, wherein said central portion consists of two adjacent parallel lengths of said wire joined by a curved portion at the end of said central portion, and said leg portions are reversely curved to have said free ends thereof extending in a direction away from said central portion curved end portion.

3. The clip type of hanger for aperture board for supporting items having an extending edge thereon as claimed in claim 2, wherein said central portion offset section and the curvature of said leg portions reversely curved portions are all on the same side of said upright plane.

4. The clip type of hanger for aperture board for supporting items having an extending edge thereon as claimed in claim 3, wherein said central portion offset section terminates in an end length, and said leg portion free ends extend in a direction aligned with said end length.

5. The clip type of hanger for aperture board for supporting items having an extending edge thereon as claimed in claim 1, wherein said central portion offset section and the curvature of said leg portions reversely curved portions are all on the same side of said upright plane.

6. The clip type of hanger for aperture board for supporting items having an extending edge thereon as claimed in claim 1, wherein said central portion offset section terminates in an end length, and said leg portion free ends extend in a direction aligned with said end length.

7. The clip type of hanger for aperture board for supporting items having an extending edge thereon as claimed in claim 1, including said items having a curved extending edge, and said central portion being on one side of said extending edge and said free ends being on the other side of said extending edge.

8. The clip type of hanger for aperture board for supporting items having an extending edge thereon as claimed in claim 7, and wherein the clip free ends are disposed on the outer curvature of said extending edge, and the clip central portion includes reversely curved sections which are disposed on the inner curvature of said extending edge, all for presenting a four-point contact of the clip relative to said extending edge.

* * * * *

UNITED STATES PATENT AND TRADEMARK OFFICE

CERTIFICATE OF CORRECTION

PATENT NO. : 4,078,755

DATED : March 14, 1978

INVENTOR(S) : John Grover Erickson

It is certified that error appears in the above-identified patent and that said Letters Patent are hereby corrected as shown below:

Change "boards" to -- board -- in line 6 of the abstract and in Column 1, line 11 and in Column 3, line 3.

Change "board" to -- boards -- in Column 1, lines 2, 42, and 56; and in Claims 2 through 8, line 1.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*